US006458065B1

(12) United States Patent
Niedermeyer

(10) Patent No.: US 6,458,065 B1
(45) Date of Patent: Oct. 1, 2002

(54) TRANSVERSE AID FOLDER WITH CYLINDER MOUNTED CUTOFF ANVILS

(76) Inventor: William P. Niedermeyer, 1024 Mt. Mary Dr., Green Bay, WI (US) 54311

( * ) Notice: Subject to any disclaimer, the term of this patent is extended or adjusted under 35 U.S.C. 154(b) by 0 days.

(21) Appl. No.: 09/499,242

(22) Filed: Feb. 7, 2000

Related U.S. Application Data

(63) Continuation-in-part of application No. 09/481,108, filed on Jan. 11, 2000.

(51) Int. Cl.[7] ..... D06F 89/00
(52) U.S. Cl. ..... 493/359; 493/357
(58) Field of Search ..... 493/359, 123, 493/313, 315, 316, 317, 318, 194, 199, 357, 340

(56) References Cited

U.S. PATENT DOCUMENTS 4,494,741 A * 1/1985 Fischer et al. ..... 270/39
4,529,141 A * 7/1985 McClenathan ..... 242/56
5,411,245 A * 5/1995 Springer et al. ..... 270/20
5,795,433 A * 8/1998 Niedermeyer ..... 156/479

* cited by examiner

*Primary Examiner*—Rinaldi I. Rada
*Assistant Examiner*—Gloria R Weeks

(57) ABSTRACT

The machine of the present invention produces folded product by advancing a web through longitudinal folding devices and transferring the unsevered continuous web to the surface of a carrier cylinder with anvils. A cooperating knife roll coacts with anvils in the carrier to cut individual product webs into segments held in place by vacuum ports communicating with internal conduits including some for direct air blast through apertures near the fold line to lift the front panel before it is passed under a stationary plate to complete the foldover. Internal conduits for air and vacuum are attached to the inside surface of the carrier cylinder using extruded or pre-molded shapes. Larger cylinders with less weight permit wider machines and circumferential space for a plurality of separate web feed and cutoff units, each of which advances separate webs at reduced speed to increase parent roll run time between roll changes. With different multiples and repeats of the cutoff units, the machine produces stacks having different pre-determined color or material sequences.

16 Claims, 5 Drawing Sheets

1
2
3
4
5
5'
6
7
8
9
10
11
12
12'
13
13'
14
15
16
16'
17
18
19
20
20'
25
26
26'
32
32'
34
35
36
37
P1
P2
A1
A2
V1
V2

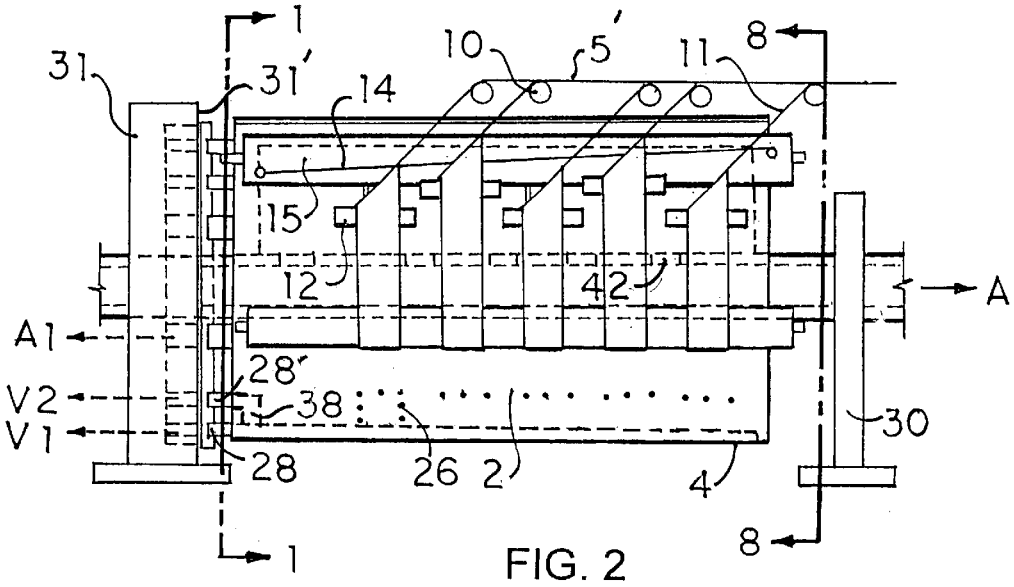
FIG. 2
FIG. 4
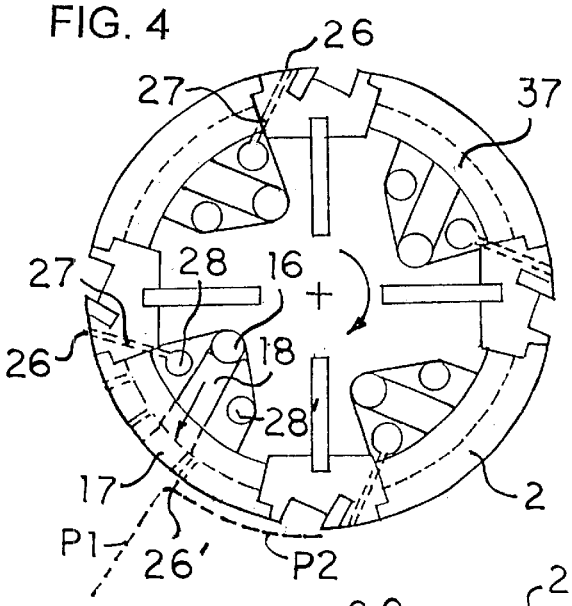
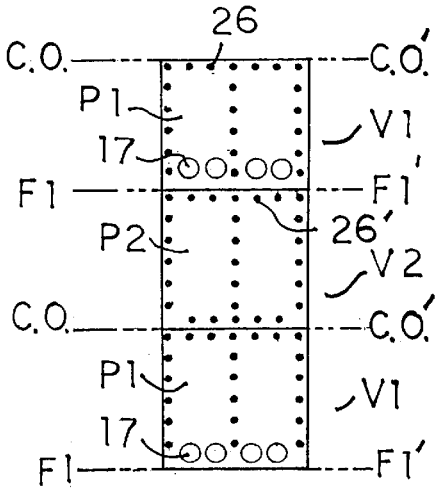
FIG. 5
FIG. 6
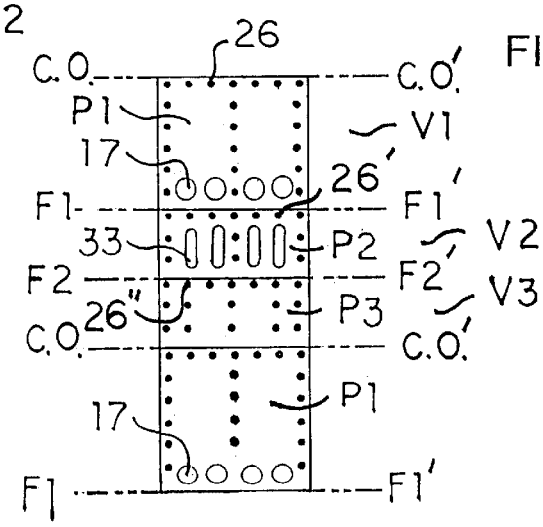

FIG. 10
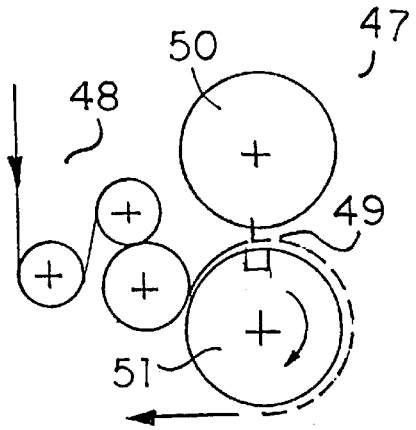
FIG. 11
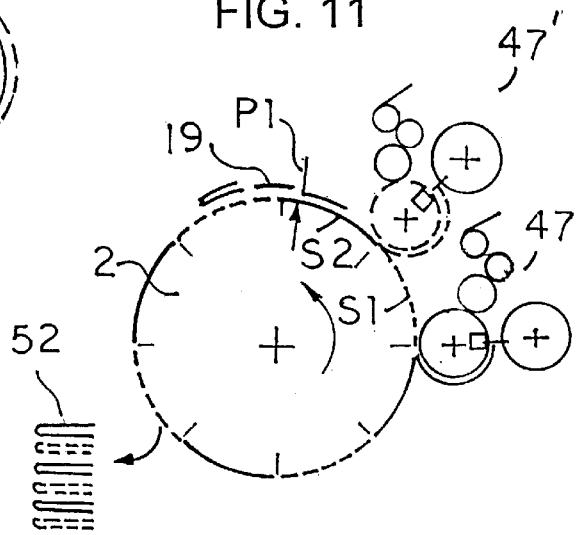
FIG. 12
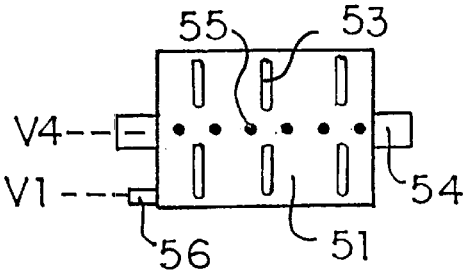
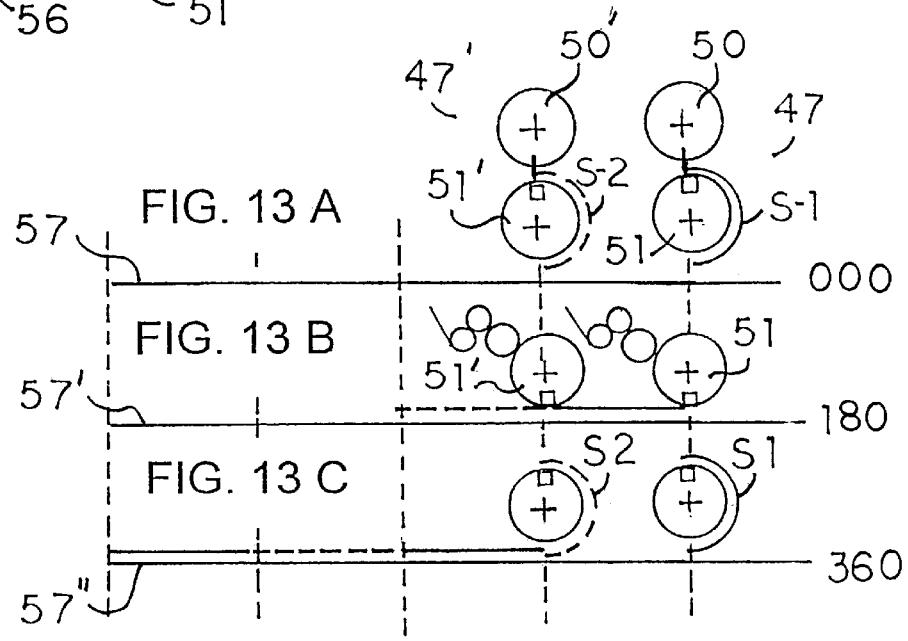

TRANSVERSE AID FOLDER WITH CYLINDER MOUNTED CUTOFF ANVILS

This application is a continuation-in-part of Ser. No. 09/481,108 filed on Jan. 11, 2000.

BACKGROUND OF THE INVENTION

This invention describes a transverse folder that uses a pre-selected pattern of vacuum ports to hold segments on a roll surface, and air pressure to blow the leading half segment upward before the lead portion is urges into superposed orientation.

The sequence for process steps is different from earlier U.S. Pat. No. 5,904,277.

This invention includes combinations of elements not heretofore described, is derivative of U.S. Pat. No. 5,904,277 and is a continuation of U.S. patent application Ser. No. 09/481,108.

In U.S. Pat. No. 5,904,277, longitudinally folded webs are cut into multi-panel segments by advancing the web through the nip between a roll with knives and a vacuumized roll with anvils. After cutting, the segment is vacuum transported and transferred to the surface of a folding/carrier roll.

Prior art vacuum folding machines like U.S. Pat. No. 1,974,149 of Christman, U.S. Pat. No. 3,689,061 of Nystrand, and U.S. Pat. No. 3,870,292 of Bradley include a knife roll coacting with an anvil roll, and a vacuumized third roll to advance the trailing half panel while the anvil roll lifts the front panel upward before superposing it over the half being advanced by the third roll.

Thus, the prior art requires two rolls to make a singlefold product and an additional third roll to make a double folded product like a dinner napkin.

In this invention, a continuous longitudinally folded web is advanced to, and superposed on, the surface of a folding cylinder which has anvils mounted at pre-selected repeats of the surface rather than being mounted in the separate roll set for cutoff.

In the present invention, the continuous web is held by vacuum ports on opposite sides of the anvil mounted in the cylinder surface while the drum rotates past knives in a coacting adjacent knife roll.

By mounting anvils in the folding cylinder and providing internal air pressure conduits operative through openings in the surface, the functions of cutting, transporting, and folding are all achieved on the same carrier cylinder before the folded product is removed from the processing path.

The separate externally mounted anvil rolls in prior art machines are eliminated by the instant invention.

In singlefold and doublefold prior art folders, inertia of the leading edge portion of an article is reversed in the process of being uplifted and backfolded and is speed limiting.

In the instant invention, both the lead and trailing portions always advance in the same direction and folding does not depend on the instantaneous depletion of vacuum required to release the folded front edge from one roll for advancement on the next.

Folding apparatus with the combination of elements described in this invention overcome the state of the art limits involving extreme weight of wide rolls or rolls with large diameter by decribing lightweight cylinders having internal conduits that are preferably mounted against the inside surface of the drum.

In this invention, use of closed conduits of readily available extruded metal shapes and/or molded plastic results in lower roll weight and less deflection in roll widths over about 80 inches.

With the new combination of elements, wider widths and cylinders with larger diameter and circumference provide space for additional secondary air pressure forces and secondary folding plates to complete a doublefold on the same cylinder.

While matching techniques have improved over the last 60 years since Christman of 1934), practical limits for 'rifle drilling' long conduit holes in solid roills still exist for state of the art folders. The instant invention overcomes these limits.

In another embodiment of the invention, wider machines can process full width webs ex-paper machine to thereby eliminate certain slitting and rewinding operstions currently required to prepare supply rolls for converting.

The inventive combinations that result in larger cylinders permit the beneficial use of two (or more) externally mounted web feed-cutoff units arranged to advance webs each at a speed equal to one half the folder web speed and placement of segments on alternate repeat surfaces of the roll. In this manner, supply rolls last twice as long before supply roll changes and threadup are required compared to conventional practice.

SUMMARY OF THE INVENTION

An object of this invention is to provide components and combinations that eliminate limitations of width imposed by limits for drilling long holes in solid rolls.

An object of this invention is to eliminate the vacuum carrier roll as a component in the cutoff unit by mounting anvils in the rticle folding roll.

An object is to provide folding cylinders with internal space for one or more high volume low pressure air flow manifolds or plenums required to blow air radially outward for single and doublefolded products.

An object is to provide wide folders having lightweight cylinders to minimize deflection of roll mounted anvils.

A further object is to provide for conduits made from readily available standard extruded metal shapes.

Another object is to provide for folder arrangements where combination internal air and vacuum conduits can be pre-molded.

A further object is to reduce roll and frame weights, lower bearing and drive transmission duty requirements and reduce motor drive power demand with lighter rolls of this invention.

An object is to define arrangements where a plurality of supply rolls run at speeds lower than the folder to lengthen the time between supply roll changes without reducing folder production speed.

A further object is to describe folder arrangements for processing full width rolls directly from the paper machine without intermediate slitting and rewinding before converting in the folder.

An object is to provide folders with larger circumferential space for mounting two or more cooperating cutoff units to place spaced segments on spaced apart repeat surfaces.

Another object of providing multiple cutoff units described above is to provide stacks of napkins each having different colored napkins in each stack and folded products of different materials.

Other objects may be seen in the ensuing specifications.

BRIEF DESCRIPTION OF THE DRAWINGS

FIG. 2 is an end elevation schematic viewed along sight line 2—2 of FIG. 1 illustrating longitudinally folded webs being transferred to the surface of a carrier/folding drum.

FIG. 4 is an end elevation schematic viewed from 1—1 of FIG. 2 illustrating a typical cylinder for a singlefold product including anvil supports from a central shaft and air/vacuum passages (see lower left hand quadrant).

FIG. 5 is a plan view schematic like FIG. 6 illustrating vacuum ports and air aperture patterns in one repeat surface for a singlefolded product.

FIG. 6 is a plan view schematic like FIG. 5 illustrating vacuum ports and air apertures patterns in one repeat surface for doublefolded product.

FIG. 10 is a side elevation view of a web cutoff assembly to advance the web at a speed slower than the velocity of a subsequent segment advancing surface after transfer.

FIG. 11 is a side elevation schematic illustrating a plurality of FIG. 10 web feed and cutoff units arranged along the periphery of a carrier/folding drum, each for transferring segments to alternate repeat surfaces.

FIG. 12 is a side elevation of a roll with low vacuum slots for web slippage and high vacuum ports for segment advancement after the web is severed.

FIG. 13A is a diagrammatic side elevation illustrating a plurality of separate knife rolls and coacting anvils at 000 reference and spaced along a carrier path to place separate segments on consecutive repeat surfaces on the carrier path.

FIG. 13B is a side elevation diagram illustrating the devices of FIG. 13A each rotated 180 degrees from reference and illustrating resultant segment deposit on a moving surface.

FIG. 13C is a side elevation diagram illustrating the devices of FIG. 13A each rotated 360 degrees from reference and the resultant sequential segment deposit from each unit on spaced apart repeat surfaces.

DETAILED DESCRIPTION

Figures 1, 3:
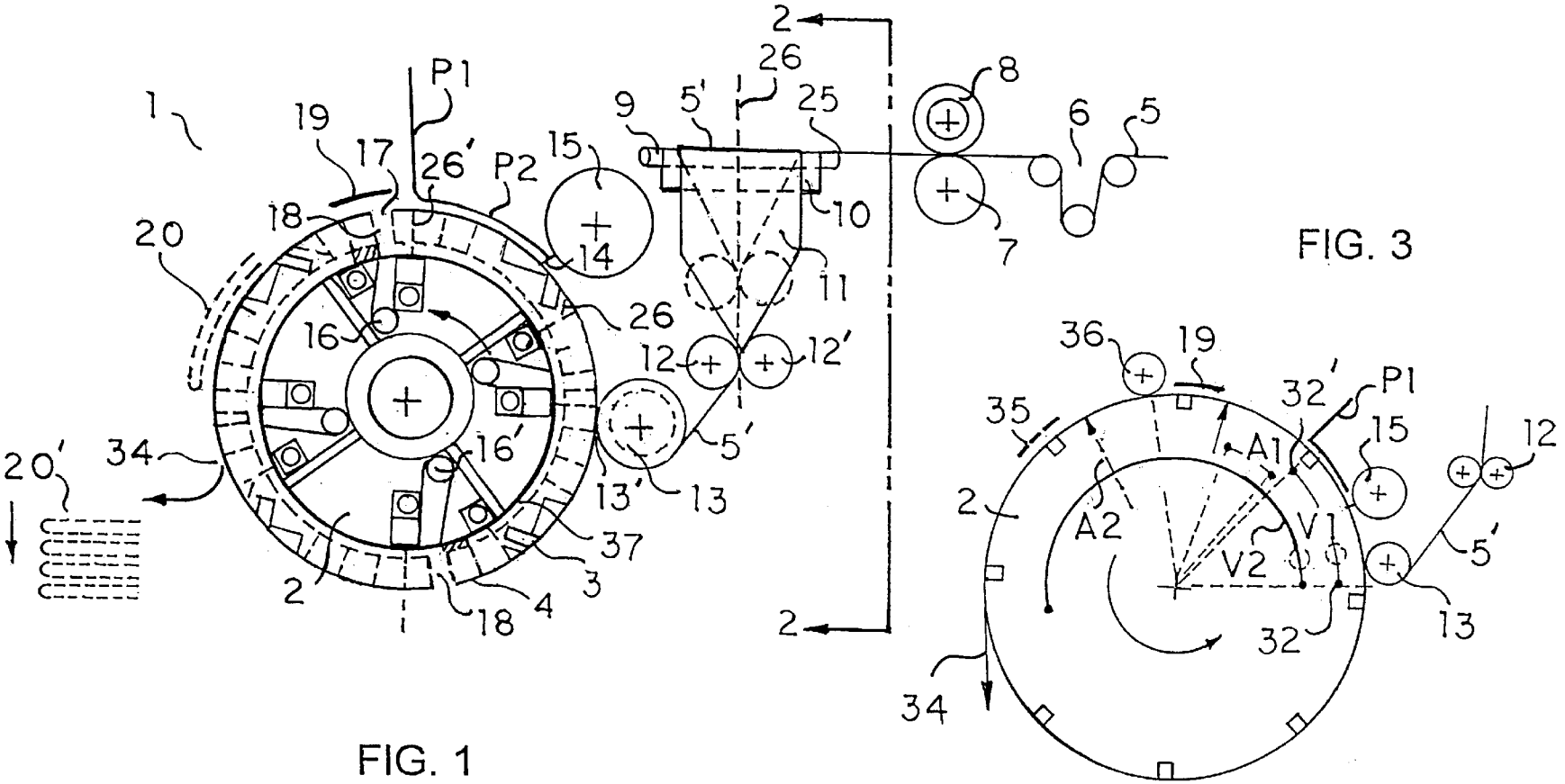
FIG. 1 is a side elevation schematic of a folder for singlefolded product viewed from sight line 1—1 of FIG. 2 illustrating the arrangement of internal components detailed in FIG. 4 and external accessories.
FIG. 3 is a diagrammatic side elevation of FIG. 1 illustrating timing of vacuum and air pressure during one repeat of the segment asdvancement cycle.

In FIG. 1, folding apparatus 1 includes carrier cylinder 2 having anvils 3 mounted at the periphery 4 for cutting operation when the anvils rotate past knife 14 in knife roll 15.

In FIG. 1, a web supply roll is supported in a frame and is unwound by a belt contacting the surface of the supply roll. These well known accessories are not shown in FIG. 1.

A web 5 from the supply roll is advanced through a 3-roll constant tension device 6 and through the nip between anvil roll 7 and slitter blades 8.

In FIG. 1, a typical 5-wide napkin folding machine accepts a 5-wide web 5 and slits it into five 1-wide webs 5', each of which are turned 90 degrees over turning bars 9 and over guide roll 10 before tensioned advancement over V-folding plate 11 by draw roll set 12, 12'.

In FIG. 1, alternate draw roll sets are shown in phantom and are located at different elevations to provide space for drive components on each roll (see FIG. 2).

A separate drive for each pull roll set 12, 12' provides independent tension control as each web passes over its respective folding plate.

In FIG. 1, as carrier cylinder 2 advances, it rotates idling nip roll 13.

Vacuum ports in the surface of cylinder 2 (see FIG. 4 and 5) hold web 5 against the carrier cylinder surface 4 as the web stretched over anvil 3 advances past knife 14 and is cut into segments.

Vacuum ports 26 are located in the fold line midway between segment ends.

In FIG. 1 after carrier cylinder 2 rotates past the segment cutting contact position (as at 29), air conduits 16, 16' are connected to air apertures 17 in surface 4 and communicate with an external air source A (shown in FIG. 2).

When air flows from apertures 17, the leading half panel 19 is blown radially outward and is folded over the trailing panel as it passes under stationary (non-rotating) plate 19.

In FIG. 1, the completed singlefolded segment (shown phantom) is advanced until it is removed from surface 4 as position 34 for subsequent stacking as at 20'.

In FIG. 2, alternate V-folding plates are vertically separated to provide space for independent drive means for each roll pair to control individual webs.

Figure 15:
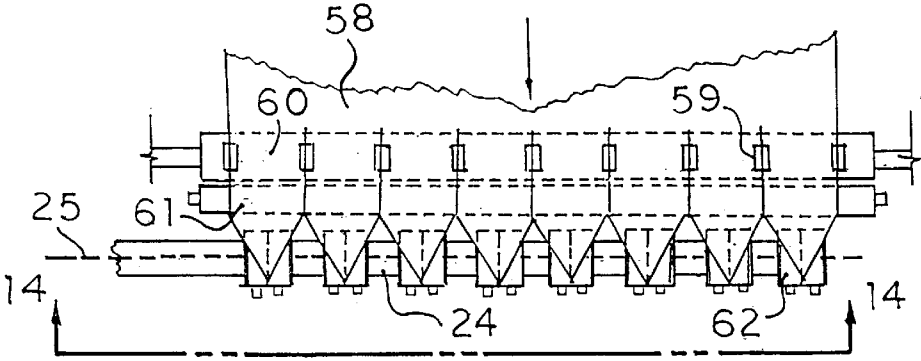
FIG. 15 is a top plan view of a full width web in FIG. 14 with each web separated and turned 90 dgrees for transfer to the advancing/folding drum.

In the FIG. 15 alignment of folding plates, a continuous ribbon of superposed webs 24 is advanced to the left along line 25 and turned 90 degrees (as at 64 in FIG. 16) corresponding to the orientation of webs 5' in FIG. 1 for subsequent advancement to the surface of carrier 2 in spaced parallel relationship (see FIG. 2).

In FIG. 2 anvils are not shown in carrier cylinder 2 for clarity.

In FIG. 2, a single web is separated from superposed webs 5' and is pluued over V-folding plates 11 by adjustable speed pulll roll sets 12 for advancement to nip roll 13 and subsequent deposit on carrier 2 as at position 13' of FIG. 1.

In FIG. 2, carrier cylinder 2 is supported for rotation in frames 30 and opposite frame 30' (not shown) mounted outside of non-rotating valve 31.

Valve 31 has grooves (not referenced) for air and vacuum in the surface 31' facing conduit connections extending from the left end of the carrier roll.

One groove is dedicated to Vacuum V1, another for V2, and a third groove for air A1.

In FIG. 3, the groove length between two groove blocks 32, 32' defines the (length) duration of air or vacuum application.

The rotary location of groove blocks determines when air or vaccum starts and stops.

Referring to FIG. 3 and 5, vacuum V1 is applied to ports 26 on lead panel 1 with V2 being applied to trailing panel P2.

Vacuum V1 stops when air pressure A1 blows the lead panel upward for subsequent foldover by plate 19 while V-2 is maintained until the folded segment is removed from the roll path as at position 34 in FIG. 3.

In FIG. 5, The lines of severance are referenced as C.O.–C.'O.' (cutoff) and the fold line between leading panel P1 and trailing panel P2 as F1–F1'.

In FIG. 6, vacuum V1 is applied to panel P1. Reference F1–F1' is the fold line for a first foldover of panel P1 after it is uplifted by air flow through apertures 17. Vacuum V2 is applied to panel P2.

In FIG. 6, patterns of vacuum ports and air apertures are arranged to complete a doublefold on carrier 2.

Vacuum V2 is applied to panel P2, vacuum V3 is applied to panel P3, (end connection not shown in FIG. 2) and air flow A2 is applied through slots 33 in close proximity to second fold line F2–F2' for completion of the doublefold as the carrier rotates under stationary plate 36. Roll 36 irons the fold after plate 19, and roll 36' (nor shown) after plate 35, etc..

In FIG. 4, the lower left quadrant shows details of connecting channels 27 between vacuum conduit 28 near the cutoff line of severance and vacuum ports 26 in the roll surface.

Transverse vacuum ports 26' along transverse fold line F1–F1' communicate with vacuum V2 in conduit 28'.

In FIG. 4, front panel P1 is folded outwardly by air blast from aperture 17 while transverse vacuum ports 26' hold panel portion P2 with vacuum from conduit 28'.

In other quadrants of FIG. 4, similar reference numbers are omitted for clarity.

Figure 7:
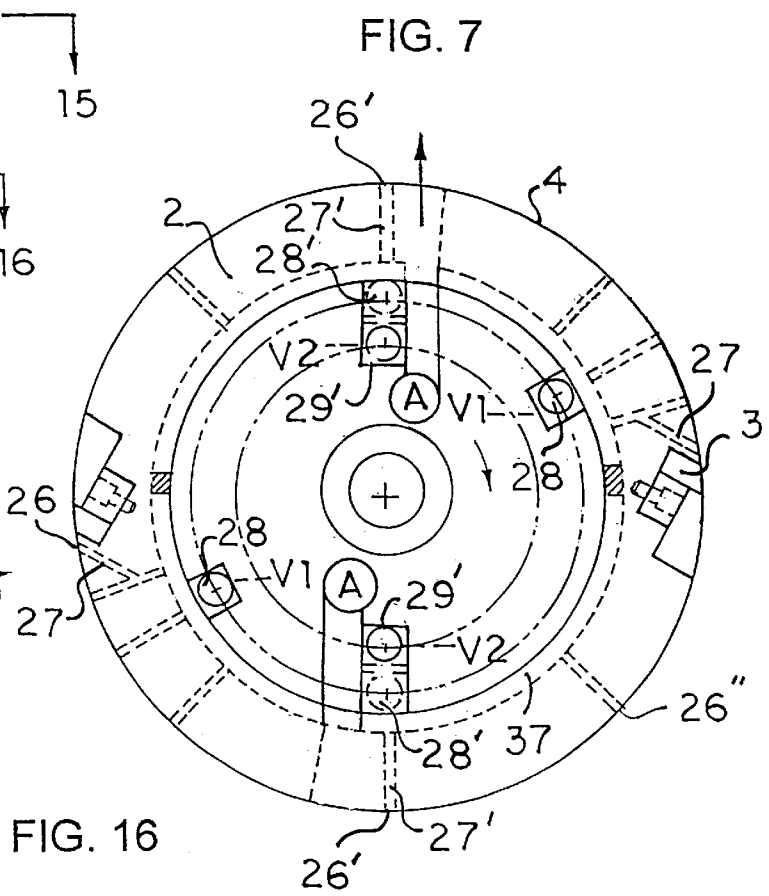
FIG. 7 is an end view schematic similar to FIG. 4 illustrating a 2-time folding cylinder with anvil mounting grooves in a self supporting roll shell having conduits with a surface superposed against an inner surface of the cylinder.

Referring to FIG. 7, vacuum ports 26 in the surface 4 of carrier cylinder 2 communicate with a vacuum source V1 thorough a series of channels 28 and conduits 29 located close to midpoint fold lines and near segment (cutoff) ends.

In FIG. 7, a preferred conduit 29 is made from a shaped or square section and is superposed against an inside surface of the carrier for subsequent drilling of ports from the surface.

Shown at the 5 o'clock position in FIG. 7, circumferential grooves 37 in a surface of the carrier cylinder provide circular conduits which can be drilled for connection to conduits 28, 28' as described.

In FIG. 7, note that reference numbers 29, 29' refer to the square extruded conduit shape. One end of each conduit rotates in sliding contact with air or vacuum grooves in a non-rotating vavle generally as shown in FIG. 2, with timing and duration of air and vacuum forces defined in FIG. 3.

In FIG. 7, a 2-time cylinder produces two segments per revolution.

Each segment is cut by anvil 3 coacting with knives in external coacting roll 15 (see FIGS. 1 and 3) while being held in place by vacuum ports connected to a vacuum source through conduits 28, 28' and grooves 37.

Referring back to FIG. 2, the lower left corner shows the conduit for vacuum V2 positioned for sliding operation with grooves in frame 31 at a smaller diameter than V1 because of offset 38.

Figure 8A:
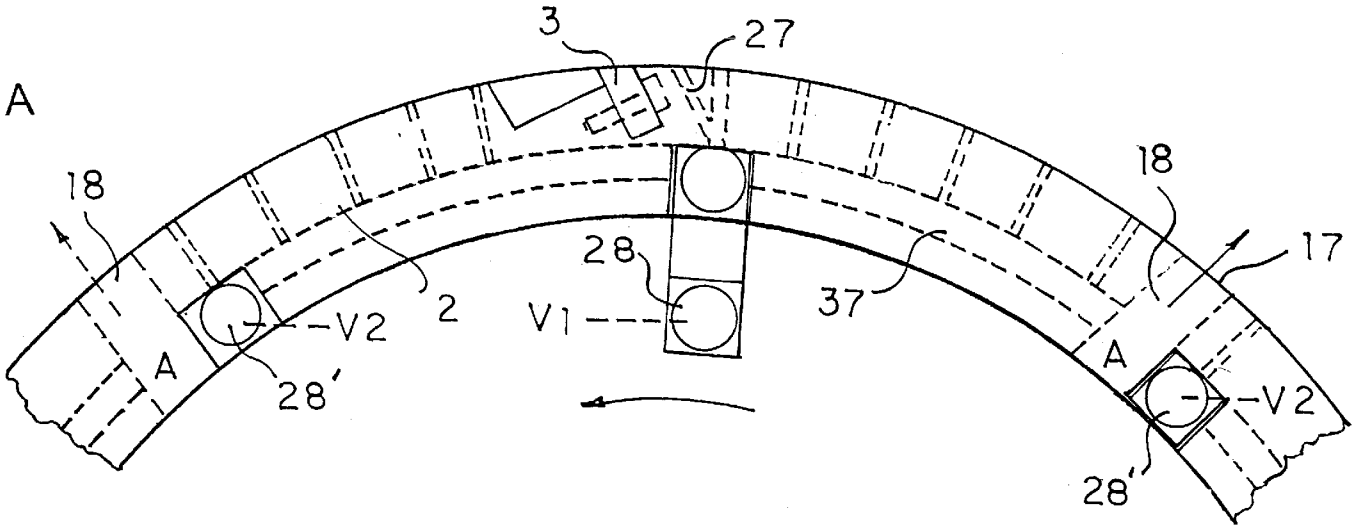
FIG. 8A is a segmental end view from sight line 8—8 of FIG. 2 illustrating anvils in a self supporting cylinder.

In FIG. 8A, vacuum conduit end connections 28 communicate with vacuum V1 and 29' connections communicate with vacuum V2.

Apertures in a surface of the shaped conduit extend vacuum to ports in the carrier surface.

Openings 18 apply pressure A which communicates with an air source (not shown).

In FIG. 8A, anvils 3 are mounted at an angle to radial lines and cutouts 39 provide clearance space for knives 14 (see FIG. 1).

Figure 8B:
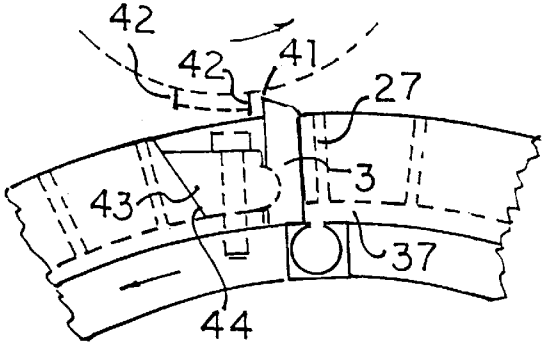
FIG. 8B is a segmental end view illustrating a self supporting hollow cylinder with radially mounted anvils and integral vacuum and air pressure conduits mounted against a roll surface.

In FIG. 8B, alternate and simplified mounting of anvil 3 in radial orientation places the tip 41 of the anvil above the periphery for cooperation with coacting knives arranged along a helix,. as at 42, 42'.

Anvil 3 is locked in place by wedge block 43 slidably shaped surface 44.

Figure 9:
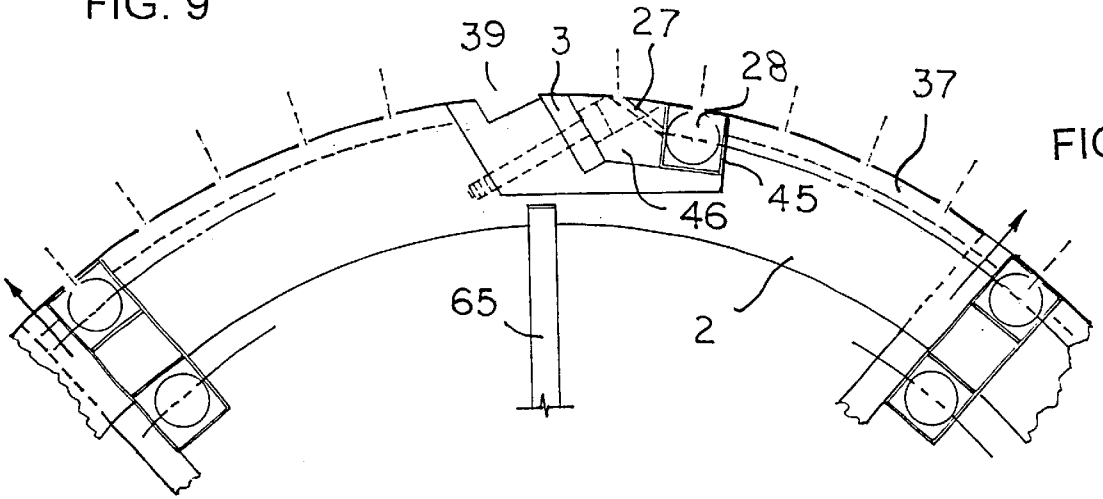
FIG. 9 is a segmental end view similar to FIG. 8 illustrating a hollow folding cylinder with anvils and supports to a central shaft and the arrangement of air and vacuum conduits on the outside of the roll.

In FIG. 9, conduit 29' is mounted in groove 45 in a surface of the cylinder 2. Anvil locking clamp 46 is pre-drilled with angled channel 27 for communication with a side surface of conduit 29'.

In FIG. 9, radially oriented members 65 support the cylinder shell from the central shaft.

In FIG. 10, web segment advancing unit 47 includes a 3-roll S-wrap feeding unit 48 to advance a continuous web through the open nip between knife roll 50 and segment transfer roll 51.

In FIG. 10, feed rolls 48 advance a web at a speed slower than the surface speed of anvil roll 51 such that a web portion equal to a segment length is advanced between knife cuts.

In FIG. 11, two segment advancing units 47, 47' are arranged to advance separate webs and cut each into segments S1, S2 respectively, and place them on alternate repeat surfaces of carrier cylinder 2.

In FIG. 11, stack 52 contains alternate folded segments from each alternate supply web, noting that webs can be advanced from different colored supply rolls.

In FIG. 12, cylinder 51 has a series of circumferentially aligned slots 53 for internal connection to low pressure vacuum source V4 through hollow shaft 54.

High vacuum V1 for transverse holes 55 is applied to conduit connection 56 for internal communication with ports 55.

In operation, the web slips on the surface of roll 51 until severance when high vacuum ports securely grip and advance cut segments at a speed match with carrier cylinder 2.

Web feed at half speed, cutoff and advancement is shown sequentially in FIGS. 13A, 13B, and 13C.

In FIG. 13A, the anvils for web advancing units 47, 47' are at 000 degrees at the instant of cutoff.

During the previous 360 degrees of revolution of rolls 51, 51', web lengths equal to segments S1 ans S2 respectively were advanced to the positions shown in FIG. 13A.

In FIG. 13A, at the instant of cutoff by knife rolls 50, 50', the cut segments advance along carrier path 57" to positions shown in FIG. 13B by the time rolls 51, 51' rotate 180 degrees (note anvil position).

In FIG. 13C, during the next half revolution, segment S1 will be placed on repeat R and S2 will be placed on R', thus providing a series of segments transferred from alternate webs.

In FIG. 15, a full width web 58 is advanced over slitters 59 and 1-wide slit webs advance over folding plates 61 and draw roll sets 62.

Figure 16:
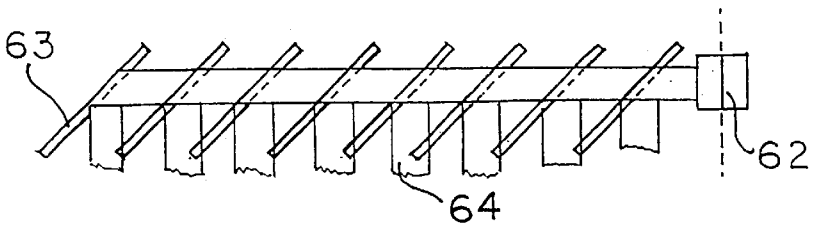
FIG. 16 is a top view of the superposed webs of FIG. 15 with each web separated and turned 90 degrees for transfer to the advancing/folding drum.

In FIG. 16, the webs from draw rolls 62 (one set shown) pass over turning bars 63 for proper orientation and transfer to the surface of carrier 2 for cutting and folding.

Figure 14:
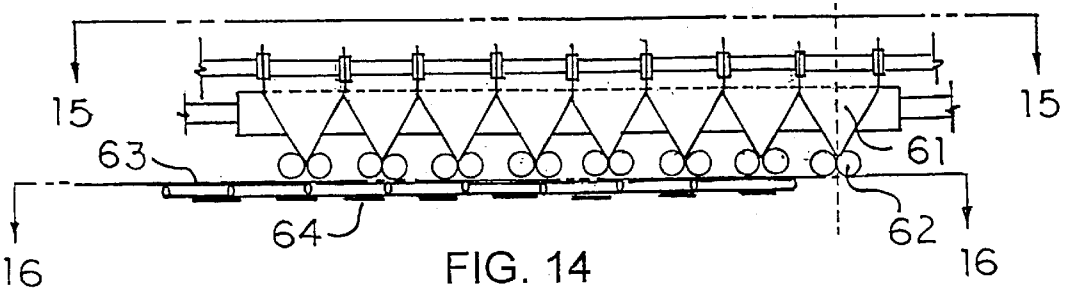
FIG. 14 is a front view of a folding plate arrangement illustrating a full width web being slit and half folded.

In FIG. 14, the functions of FIGS. 15 and 16 are combined.

While in the foregoing specification, specific embodiments are described, it is to be understood that the present invention may be embodied in other specific forms without departing from the spirit or special attributes, and it is, therefore, desired that the present embodiments be considered in all respects as illustrative and therefore not restrictive, reference being made to the appended claims rather than to the foregoing description to indicate the scope of the invention.

Having thus described the invention, what is claimed as new and desired to protect by Letters Patent are the following:

1. An article folding apparatus comprising:

means to support a supply roll for rotational unwinding of a web, means to unwind said web from said supply roll, means to longitudinally fold and advance said web, means to transfer said web to the outer surface of a carrier cylinder and having a path with a beginning and an end, said carrier including segment cutoff means comprising at least one anvil mounted for operation at the outer surface of said carrier cylinder in cutting cooperation with a knife mounted in an adjacent roll, said carrier cylinder comprising a hollow cylindrical shell for rotation on a centrally positioned shaft, shell support means therebetween, and at least one closed channel conduit in contacting relationship with the inside surface of said shell, said conduit arranged parallel to said shaft for communication between said conduit, vacuum port plurlities in the surface of said shell, and a vacuum source, at least one of said pluralities of vacuum ports arranged to hold the leading panel of said segment on one side of a first fold line and, at least one other of said pluralities of vacuum ports arranged to hold the trailing panel of said segment, said leading panel portion of said carrier support surface including at least one air pressure aperture proximate to said first fold line, said air pressure communicating with a remote air pressure source via an air conduit, means to apply a first positive upward force through said air pressure apertures, non-rotating means to apply a second positive force to fold a leading panel portion of said segment into superposed relationship with a trailing portion, means to remove the folded article from said carrier path.

2. The apparatus of claim 1 wherein vacuum conduits are in contacting relationship with a portion of linear transverse cutouts in a surface of said carrier cylinder.

3. The apparatus of claim 1 wherein said vacuum conduits are arranged transversely on the outside surface of said carrier cylinder.

4. The apparatus of claim 1 wherein one of said plurality of vacuum ports holds a portion of said trailing panel, said trailing panel being bisected about a second fold line.

5. The apparatus of claim 4 wherein an additional first force means and an additional second force means are applied to complete a second transverse fold about a second fold line.

6. The apparatus of claim 5 wherein at least one of said air apertures is in close proximity to said first fold line and at least one is close to a second fold line F2–F2'.

7. The apparatus of claim 1 wherein said second force means is a stationary plate not rotatable about said carrier shaft.

8. The apparatus of claim 1 wherein conduits supplying vacuum to said first and second pluralities of ports have one surface in contact with the inside surface of said carrier and include connections that communicate with different vacuum grooves of a cooperating vacuum valve, each of said grooves having a different diameter.

9. The apparatus of claim 1 wherein said air apertures include an air plenum having a pervious surface substantially contiguous with the surface of the carrier.

10. The apparatus of claim 1 wherein the major dimension of at least one of said air apertures is parallel with the direction of segment advancement.

11. The apparatus of claim 1 wherein at least one of said air and vacuum conduits includes at least two direction changes in the fluid path.

12. The apparatus of claim 1 comprising:

a plurality of cutoff means including coacting knives and anvils, each of said rolls having a multiple of repeats divisible by the product repeat length, each of said cutoff units arranged to cut and deposit segments on spaced repeat surfaces of said carrier, each of said segments placed on a spaced apart repeat surface of said carrier path in juxtaposed end-to-end relationship with an adjacent segment cut and placed on the carrier surface by another cutoff unit.

13. The apparatus of claim 12 wherein said first and second positive forces are applied to each segment of a series after segment placement on said repeat surfaces.

14. The apparatus of claim 12 wherein the number of repeats on the carrier cylinder with anvils is a multiple of the number of cutoff units.

15. The apparatus of claim 12 wherein said anvil repeat surfaces have an end-to-end dimension greater than product length.

16. The apparatus of claim 1 wherein a plurality of draw roll sets installed downstream of folding plates rotate on axes parallel to the direction of web travel from said parent roll and engage the folded web before said folded web is threaded around turning bars.

* * * * *